United States Patent [19]

Brookes et al.

[11] Patent Number: 4,481,040

[45] Date of Patent: Nov. 6, 1984

[54] PROCESS FOR THE CHEMICAL DISSOLUTION OF OXIDE DEPOSITS

[75] Inventors: Ian R. Brookes; Malcolm E. Pick, both of Bristol, England

[73] Assignee: Central Electricity Generating Board of Sudbury House, London, England

[21] Appl. No.: 387,094

[22] Filed: Jun. 10, 1982

[30] Foreign Application Priority Data

Jun. 17, 1981 [GB] United Kingdom ..... 8118680

[51] Int. Cl.[3] ..... B08B 7/04; C23G 1/02

[52] U.S. Cl. ..... 134/3; 134/13; 134/27; 134/28; 134/41; 252/626

[58] Field of Search ..... 134/3, 13, 27, 28, 41; 252/626; 376/310

[56] References Cited

U.S. PATENT DOCUMENTS

| | | | |
|---|---|---|---|
| 3,013,909 | 12/1961 | Pancer et al. | 134/3 |
| 3,080,262 | 3/1963 | Newman | 134/27 X |
| 3,496,017 | 2/1970 | Weed | 134/28 X |
| 3,615,817 | 10/1971 | Jordan et al. | 134/41 X |
| 3,664,870 | 5/1972 | Oberhofer et al. | 134/3 |
| 3,873,362 | 3/1975 | Mihram et al. | 134/28 X |
| 4,226,640 | 10/1980 | Bertholdt | 134/28 X |

FOREIGN PATENT DOCUMENTS

| | | | |
|---|---|---|---|
| 2064852 | 6/1981 | United Kingdom | 252/626 |

*Primary Examiner*—Marc L. Caroff

*Attorney, Agent, or Firm*—Beveridge, DeGrandi & Kline

[57] ABSTRACT

Oxide deposits containing chromium are dissolved by contacting the deposits sequentially with (i) a permanganate salt in acid solution to remove chromium therefrom as hexavalent chromium;

(ii) a reducing agent in acid solution to destroy excess permanganate ions and manganese dioxide formed by reduction of the permanganate; and (iii) a mixture of a reducing agent and complexing acid to dissolve the residual chromium depleted oxide.

10 Claims, No Drawings

PROCESS FOR THE CHEMICAL DISSOLUTION OF OXIDE DEPOSITS

The present invention relates to a process for the chemical dissolution of oxide deposits and, in particular for the chemical decontamination of the oxide deposits formed on the structural surfaces of pressurised water reactors.

The oxide in the primary circuit of a reactor becomes contaminated with activated species such as $^{60}Co$, $^{58}Co$ and $^{54}Mn$ during operation leading to a build-up of radiation fields on pipework and components. Maintenance and inspection work may then expose operating staff to excessive radiation doses. Thus, there is a requirement to reduce radiation fields by decontamination.

Typically, the oxide on the stainless steel and nickel base alloy surfaces of a pressurised water reactor is enriched in chromium. Attempts to dissolve it using reducing acid mixtures such as oxalic acid with citric acid and ethylenediamine tetra-acetic acid have been largely unsatisfactory. However, processes which are preceded by an oxidising stage have given good decontamination results. The most commonly applied process of this type is a two-stage process involving treatment with an alkaline permanganate followed by ammonium citrate. However, this process has some practical drawbacks which prevent its ready application. In particular, it uses relatively high concentrations of chemicals and it produces a waste solution which is not readily amenable to economic treatment by ion exchange. Moreover, due to the incompatibility of the alkaline and acid treatment stages in the process it is necessary to rinse between stages, which extends considerably the process time. The rinses also increase the volume of waste solution considerably, leading to a requirement for large storage tanks.

We have now developed a permanganate based oxidative decontamination treatment for oxide deposits formed on the structural surfaces of pressurized water reactors which does not necessitate the use of any rinses.

Accordingly, the present invention provides a process for the chemical dissolution of oxide deposits containing a proportion of chromium and, in particular, for the chemical decontamination of oxide deposits contaminated with activated species (as hereinafter defined) which process comprises treating the oxide deposits sequentially with (i) a permanganate salt in acid solution to remove chromium therefrom as hexavalent chromium:

(ii) a reducing agent in acid solution to destroy excess permanganate ions and manganese dioxide formed by reduction of the permanganate; and (iii) a mixture of reducing agent and complexing acid to dissolve the residual chromium depleted oxide.

In certain practical situations it may be desirable to commence the addition of the phase (iii) chemicals before the reaction of a phase (ii) is complete.

We have found that the process is effective in removing chromium as hexavalent chromium from the oxide deposits even at low concentrations of permanganate salt in dilute acid. The removal of chromium leaves a chromium depleted oxide. Excess permanganate ions and manganese dioxide formed by reduction of the permanganate are then destroyed by the addition of a reducing agent in acid solution, preferably oxalic acid and nitric acid. The residual chromium depleted oxide is then dissolved by the addition of a mixture of a reducing agent and complexing acid, preferably oxalic acid and citric acid. The process is a single continuous operation with additions of chemical reagents in sequence and no rinses are required. The solution remaining at the end of the process can be readily and economically cleaned directly by ion exchange.

By the term "activated species" as used herein is meant those radioactive ions which are formed by the constituent elements of the construction materials of water-cooled nuclear reactors becoming neutron activated, such as $^{60}Co$, $^{58}Co$ and $^{54}Mn$.

The reagents used in the process of the invention are readily soluble in water. A temperature of 95° C. has been found to provide excellent results, although lower temperatures may be used but the process then works more slowly. Potassium permanganate is the preferred permanganate salt for use in the invention.

The first phase of the process is generally carried out for a period of from 5 to 24 hours, depending on oxide thickness. The permanganate oxidises $Cr^{3+}$ in the oxide to the $Cr^{6+}$ state which gives soluble bichromate ions in solution:

$$Cr^{3+} + 4H_2O \rightleftharpoons HCrO_4^- + 7H^+ + 3e^-$$

$$MnO_4^- + 3e^- + 4H \overset{+}{\rightleftharpoons} MnO_2 + 2H_2O$$

Net Reaction $$Cr^{3+} + MnO_4^- + 2H_2O \rightleftharpoons HCrO_4^- + MnO_2 + 3H^+$$

The second phase reagents are added to destroy the excess permanganate ions and manganese dioxide formed in the above reaction. The permanganate is destroyed rapidly, manganese dioxide destruction takes a little longer, usually between 0.5 and 1 hours.

(a) permanganate destruction $$2MnO_4^- + 5H_2C_2O_4 + 6H^+ = 2Mn^{2+} + 10CO_2 + 8H_2O$$

(b) manganese dioxide destruction $$MnO_2 + H_2C_2O_4 + 2H^+ = Mn^{2+} + 2CO_2 + 2H_2O$$

For the third phase of the process two options are available. In the first option a mixture of oxalic and citric acid is added, together with potassium hydroxide, to maintain the solution pH at 2.5. In the second option a mixture of oxalic and citric acids alone is added to give a pH 2.5 solution after the decontamination solution has been deionised at the end of the second phase when the excess permanganate and manganese dioxide have been destroyed. In this case reduced quantities of oxalic and citric acid are added because they are then continuously regenerated on a cation exchange resin. Dissolution of the residual chromium depleted oxide by the third phase reagents is fairly rapid and further dissolution will usually have ceased after treatment for 2 to 7 hours at 95° C.

Typical reagent concentrations which may be used in the process of the invention are given below:

PHASE I. FIRST ADDITION OF REAGENTS

Potassium permanganate 1.0 g $dm^{-3}$
+
Nitric acid to give pH 2.5 solution ≡ 0.25 g $dm^{-3}$ -continued

| |
|---|
| (0.003 M) |

PHASE II. SECOND ADDITION OF REAGENTS

Oxalic acid 1.4 g $dm^{-3}$
+
Nitric acid 1.7 g $dm^{-3}$

PHASE III. THIRD ADDITION OF REAGENTS

| either IIIa | or IIIb |
|---|---|
| Oxalic acid 0.45 g $dm^{-3}$ (0.005 M) | Oxalic acid 0.225 g $dm^{-3}$ (0.0025 M) |
| + | + |
| Citric acid 0.96 g $dm^{-3}$ (0.005 M) | Citric acid 0.48 g $dm^{-3}$ (0.0025 M) |
| + | |
| Potassium hydroxide 0.42 g $dm^{-3}$ | |

The waste solution produced in the process of the present invention may be directly treated by ion exchange. For the typical reagent concentrations given above, for the complete process with the IIIa option the metal cation concentration of the reagent solutions is 27 milliequivalents $dm^{-3}$ of $K^+$ and $Mn^{2+}$ and the anion concentration 47 milliequivalents $dm^{-3}$ of total anions. In order to treat 1 $m^3$ of reagent solution about 9 kg of a strong acid cation resin (e.g. Amberlite IR-120) and 9 kg of a weak base anion resin (e.g. Amberlite IRA-60 or Ionac A-365) would be required. In addition, of course, there is the cation resin required to treat the cations from the dissolved oxide and this amount will be dependent upon the characteristics of the item being decontaminated. For a typical pressurized water reactor it would be unlikely to exceed 10 milliequivalents $dm^{-3}$, thus requiring an extra 3 kg of cation resin per $m^3$ of reagent solution.

For the process with the IIIb option the decontamination solution is deionised after phase II when the excess permanganate and manganese dioxide have been destroyed. If this is carried out then the IIIb reagents can be added and employed in a regenerable manner. In this mode the solution used during phase IIIb is continuously circulated through a cation exchange resin which removes the dissolved metal ions and regenerates the acids for further use. This adaptation which increases the oxide dissolution capacity of the citric/oxalic solution, may be beneficial where the oxide layer is relatively thick.

The following Example illustrates the process of the invention.

EXAMPLE

The process of the invention has been carried out on A1S1 Type 304 stainless steel items from three pressurized water reactors. The decontamination factors obtained are listed in Table 1. The ease of application and waste treatment with the process of the invention means that it is very easy to repeat it in order to increase the decontamination factors, if required. The Table gives results for both one and two applications of the process of the invention.

TABLE 1

Decontamination Factors (DF) Obtained on Pressurised Water Reactor Samples

| Reactor | Application time for Each Phase of Process, Hours I | II | IIIa | Total Hours | DF After One App: | DF After Two App: |
|---|---|---|---|---|---|---|
| A | 5–10 | 0.5 | 5 | 10–15 | 6–10 | ~100 |
| B | 5–10 | 0.5 | 5 | 10–15 | 5–8 | ~20 |
| C | 24 | 0.5 | 5 | 29.5 | 4–25 | ~50 |

The longer application time for the potassium permanganate solution with a reactor C sample was necessary because it had a much thicker oxide (~5 μm) than the reactor A and reactor B (<1 μm) samples.

Comparative tests with other decontamination procedures were performed, notably with the Canadian 'CANDECON' process (Lacy et al.,) British Nuclear Energy Society, International Conference on Water Chemistry of Nuclear Reactor Systems, Bournemouth, England, 385–391) and a version of the alkaline permanganate (APAC) process developed by the Russians for use on stainless steel steam generators (Golubev et al., Soviet Atomic Energy 44, 5,504–506). The 'CANDECON' process was applied for 24 hours at 95° C. in the tests but was not effective and gave a DF of only 1.1 on Reactor B specimens. The Russian process gave a DF of 4.3 which is similar to that from the process of the invention but like all methods using alkaline permanganate it requires rinsing between stages resulting in a large volume of waste solution not amenable to direct treatment by ion exchange.

We claim:

1. In a process for the chemical dissolution of oxide deposits containing a proportion of chromium and in particular for the chemical decontamination of oxide deposits contaminated with activated species the improvement which consists essentially of contacting the oxide deposits sequentially with (i) a permanganate salt in acid solution to remove chromium therefrom as hexavalent chromium;

(ii) a reducing agent in acid solution to destroy excess permanganate ions and manganese dioxide formed by reduction of the permanganate; and (iii) a mixture of a reducing agent and complexing acid to dissolve the residual chromium depleted oxide.

2. A process according to claim 1 wherein the contacting with the phase (iii) chemicals is commenced before the reaction of phase (ii) is complete.

3. A process according to claim 1 wherein the permanganate salt is potassium permanganate.

4. A process according to claim 1 wherein treatment (i) is carried out for a period of time of from 5 to 24 hours.

5. A process according to claim 1 wherein treatment (ii) is carried out for a period of time from 0.5 to 1 hour.

6. A process according to claim 1 wherein treatment (ii) is carried out using a mixture of oxalic acid and nitric acid.

7. A process according to claim 1 wherein treatment (iii) is carried out for a period of time of from 2 to 7 hours.

8. A process according to claim 1 wherein treatment (iii) is carried out using a mixture of oxalic acid and citric acid.

9. A process according to claim 1 which is carried out at a temperature of 95° C.

10. A process according to claim 1 wherein waste solution therefrom is treated with at least one ion exchange resin.

* * * * *